United States Patent [19]

Tasset et al.

[11] Patent Number: 4,524,011

[45] Date of Patent: Jun. 18, 1985

[54] FLUX REMOVAL SOLVENT BLEND

[75] Inventors: Emmett L. Tasset, Clute, Tex.; Susan M. Dallessandro, Midland, Mich.; Warren F. Richey, Lake Jackson, Tex.

[73] Assignee: The Dow Chemical Company, Midland, Mich.

[21] Appl. No.: 549,364

[22] Filed: Nov. 4, 1983

Related U.S. Application Data

[63] Continuation-in-part of Ser. No. 439,699, Nov. 8, 1982, abandoned.

[51] Int. Cl.[3] ..... C11D 7/50

[52] U.S. Cl. ..... 252/171; 134/38; 134/42; 252/364; 252/170

[58] Field of Search ..... 134/38, 42; 252/153, 252/171, 364; 570/102, 108, 110, 114, 115, 116

[56] References Cited

U.S. PATENT DOCUMENTS

| | | | |
|---|---|---|---|
| 2,811,252 | 10/1957 | Bachtel | 206/84 |
| 2,838,458 | 6/1958 | Bachtel | 252/171 |
| 2,923,747 | 2/1960 | Rapp | 260/652.5 |
| 3,000,978 | 9/1961 | Fredenburg | 260/652.5 |
| 3,128,315 | 4/1964 | Hardies | 260/652.5 |
| 3,159,582 | 12/1964 | Sims | 252/153 |
| 3,192,273 | 6/1965 | Bissinger | 252/171 X |
| 3,251,891 | 5/1966 | Cormany et al. | 260/652.5 |
| 3,326,988 | 6/1967 | Stack | 252/171 X |
| 3,549,715 | 12/1970 | Cormany et al. | 260/652.5 |
| 3,671,446 | 6/1972 | Schofield et al. | 252/171 |
| 3,733,218 | 5/1973 | Begun | 134/38 |
| 3,932,297 | 1/1976 | Clementson et al. | 252/171 |
| 3,937,665 | 2/1976 | Mammino et al. | 252/162 |
| 3,974,230 | 8/1976 | Archer et al. | 260/652.5 R |
| 4,023,984 | 5/1977 | Clementson et al. | 134/38 |
| 4,056,403 | 11/1977 | Cramer et al. | 134/22 R |
| 4,086,179 | 4/1978 | Schneider | 252/171 |

FOREIGN PATENT DOCUMENTS

| | | |
|---|---|---|
| 44111 | 1/1982 | European Pat. Off. . |
| 2214597 | 10/1972 | Fed. Rep. of Germany . |
| 55-127326 | 10/1980 | Japan . |
| 56-159299 | 12/1981 | Japan . |
| 1405692 | 9/1975 | United Kingdom . |
| 2069995 | 9/1981 | United Kingdom . |

*Primary Examiner*—Prince E. Willis
*Attorney, Agent, or Firm*—A. C. Ancona

[57] ABSTRACT

Superior solder flux, e.g., rosin flux, removal compositions are disclosed which have no flash point and are substantially non-corrosive toward aluminum. These compositions consist of about 0.5 to less than 2% methanol with about 3 to 10% of one or more alcohols containing 2–5 carbon atoms the balance being an inhibited 1,1,1-trichloroethane, wherein percentages are based on volume of the total composition.

11 Claims, No Drawings

FLUX REMOVAL SOLVENT BLEND

CROSS REFERENCE TO RELATED APPLICATION

This is a continuation-in-part of copending application Ser. No. 439,699 filed Nov. 8, 1982 abandoned.

BACKGROUND OF INVENTION

The electronics industry requires circuit boards which are substantially free of ionic and organic flux residues since such contribute to failure of the circuit board in use. Therefore, stringent methods are employed to clean the boards of both ionic and organic residues. Numerous solvents and mixtures of solvents have been tried and discarded. The most widely used commercial solvent is 1,1,2-Trifluoro-1,2,2-trichloroethane (Fluorocarbon 113) in admixture with 10.67 volume percent methanol and 0.33 volume percent nitromethane. This solvent effectively cleans from the soldered circuit board the rosin flux soldering aids. The cleaning effectiveness is measured by standard procedures in the industry, one of which is set by the U.S. military which is a specification for "Printed Wiring Assemblies" MIL-P-28809. This test consists of spraying or immersing the cleaned board in a freshly prepared aqueous isopropyl alcohol solution for a specified period of time after which the resistivity of the solution is measured in ohm-cm. The effectiveness of a flux removal blend is a function of the cleaning time, flux composition and the type of cleaning operation. All these being equal, the more effective blends will give a higher specific resistance value when tested according to the above test or similar standard test.

The above mentioned fluorocarbon blend has been shown by industrial experience and by means of the above test to be an effective flux removal solvent. Generally, chlorinated hydrocarbons alone or in combination with alkanols below the flash point level give poorer results, particularly with respect to removal of ionic components of the flux. It is important that the blends used by the industry have no flash point for obvious safety reason.

It is also known that chlorinated hydrocarbons, especially 1,1,1-trichloroethane (methylchloroform), will remove the nonionic components of the rosin flux solder aids better than the aforementioned fluorocarbon blend.

Two patents disclosing flux removing compositions are U.S. Pat. Nos. 3,932,297 and 4,023,984, claiming methylchloroform with n-propyl alcohol and isopropyl alcohol, respectively; and an azeotropic composition of a fluorocarbon and n-butyl alcohol is disclosed in U.S. Pat. No. 3,671,446 as useful in cleaning circuit boards.

It, therefore, would be advantageous to have a chlorinated solvent composition which will effectively remove both ionic and nonionic flux residues and has no flash point. The present invention provides such a composition.

SUMMARY OF THE INVENTION

Stable methylchloroform solvent compositions in combination with from about 0.5 to less than 2% by volume of methanol and from about 3 to about 10% by volume of at least one alcohol having from 2 to 5 carbon atoms have proven to be superior flux removal solvents. These compositions also have no flash point.

DETAILED DESCRIPTION OF THE INVENTION

A series of experiments was carried out employing several formulations of chlorinated hydrocarbons and a 1,1,2-trifluoro-1,2,2-trichloroethane formulation which is widely used by industry to remove flux residues from circuit boards.

Test Procedure

Coupons of electronic circuit board base material (1"×1×1/16") were cleaned by immersion in two clean baths of 75 volume percent isopropyl alcohol and 25 volume percent water agitated by an ultrasonic vibrator. The clean coupons were placed in a nitrogen dry box until used.

Each clean coupon was removed from the dry box and immediately immersed horizontally into an Alpha 711-35 MIL flux for five minutes. The Alpha 711-35 MIL flux is widely used by circuit board manufacturers. The coupons were then hung horizontally to dry for five minutes.

Thereafter, the coupon was reflowed in a horizontal position in an oven at 250° C. for 15 seconds to simulate actual use conditions. After heating, the coupon was again hung in a nitrogen dry box until used in the cleaning experiments.

In conducting the cleaning comparisons, a flux coated coupon taken from the dry box was hung from a clip and (1) introduced into a vapor zone of the flux removal solvent formulation for thirty (30) seconds, (2) immersed in the boiling solvent for thirty (30) seconds, (3) raised above the vapor zone into the free board area above the vapor zone for thirty (30) seconds, then (4) back into the vapor zone for a final thirty (30) seconds and (5) removed to a hanger to dry.

Each coupon after drying was tested for cleanliness by immersing the coupon in 40 ml of a pure solvent consisting of an admixture of isopropyl alcohol and water, 75/25 volume percent, respectively, while the solvent was subjected to ultrasonic vibration for five (5) minutes. Upon removal of the coupon, the resistivity of the aqueous alcohol solution was measured using a clean one (1) mm conductivity bridge for each measurement. The mean result of several measurements for each of the enumerated formulations was obtained. The higher the resistivity value, the more effective is the removal of the ionic flux residues.

A second test was conducted on the flux removal blends with respect to their resistance to corrosion of aluminum. The test consisted of placing aluminum (Al 2024) shavings in a flask containing the liquid solvent blend. A condenser was attached to the flask and the solvent heated to boiling and refluxed by the condenser for a period of seven days, during which time observations were made of the shavings. If no corrosion of the aluminum was observed by the end of seven days, the blend was considered to have passed the test.

The flash point of each blend was also determined*. If the blend had a flash point, it was considered to have failed. No observable flash point indicates the solvent passed, or was acceptable. The results of flash point and corrosion tests are given in Table I, failed and passed being indicated by F and P, respectively.

*The method used was ASTM-92 known as the Cleveland Open Cup flash point method.

EXAMPLE 1

The above test procedures were conducted using a commercially available inhibited methylchloroform consisting of:

95.7% Methylchloroform (MC)
0.7% 1,2-Butylene oxide (BO)
0.4% Nitromethane (NM)
3.2% Diethylene ether (DEE); and

EXAMPLE 2

A commercially available flux removal blend was also tested as above. The blend consisted of:

89% Fluorocarbon 113
10.67% Methanol
0.33% Nitromethane.

EXAMPLE 3

The above test was also performed using the inhibited methylchloroform of Example 1 (92.5%) with 7.5% 2-butanol, which is also a commercially available product.

Percentages in Examples 1–3 above as well as succeeding examples are all by volume unless otherwise indicated.

Table I shows the results of testing for the blends of Examples 1–3 above and others known to the art. Examples 7–13 employ 10% of several different alcohols with the inhibited methylchloroform of Example 1.

TABLE I

| Ex. No. | Blend[1] MeOH (%) | SBA (%) | MBY (%) | FP[2] | Al Corrosion | Specific Resistance[3] (× $10^5$ ohm-cm) |
|---|---|---|---|---|---|---|
| 1 | — | — | — | P | P | 2 |
| 2 | 10.67 | — | — | P | P | 15 |
| 3 | — | 7.5 | — | P | P | 8 |
| 4 | 1 | — | — | P | P | 11 |
| 5 | 2 | — | — | F | P | 18 |
| 6 | — | — | 12 | F | P | — |
| 7 | — | — | 10 | P | P | 6 |
| 8 | — | 10 | — | F | P | 9 |
| 9 | Ethanol 10% | | | F | F | 15 |
| 10 | Isopropanol 10% | | | F | F | 13 |
| 11 | Isobutanol 10% | | | — | — | 9 |
| 12 | Tert-butanol 10% | | | — | — | 6 |
| 13 | Dowanol PM* 10% | | | — | — | 5 |

MEOH = methanol, SBA = 2-butanol, MBY = 2-methyl-3-butyn-2-ol
[1]Volume percent additives, balance being the blend of Example 1. Other components of Examples 1, 2 and 3 are shown preceding Table I.
[2]Cleveland Open Cup Flash Point
[3]Test Method - Modified from "A Comparison of Removal of Activated Rosin Flux by Selected Solvents," Technical Paper by Turbini, Engle, and Stark, Western Electric Company, Princeton, N.J.
*Trademark of The Dow Chemical Company for the monomethylether of propylene glycol.

It should be noted that Examples 1–13 are comparative and do not fall within the scope of the invention.

The inhibited methylchloroform of Example 1 is not effective in removing ionic components of the flux. Examples 2 and 3 demonstrate the present state of the art in cleaning ionic residues with commercially available blends which do not have a flash point. It is apparent that the fluorocarbon blend is more effective than the butanol-methylchloroform blend. It is also apparent from Examples 4–13 that a single alcohol blended with methylchloroform will not yield a formulation which will give comparable results to the fluorinated blend and still have no flash point. Examples 4 and 5 show that 1% methanol in methylchloroform gives no flash point whereas 2% methanol has a flash point.

A number of stabilized methylchloroform (Example 1) flux-removal compositions containing various amounts of methanol together with other alcohols were tested on the same flux as above in accordance with the above described procedures. Results are shown in Table II as Examples 14–35. These examples show that some 1,1,1,-trichloroethane blends with methanol, sec-butanol and/or 2-methyl-3-butyn-2-ol which have no flash point unexpectedly have better ionic residual flux removal performance than the fluorocarbon blend of Example 2. The preferred blends contain about 1% methanol and about 6% of sec-butanol and/or 2-methyl-3-butyn-2-ol. The blends containing 0.5% methanol are slightly inadequate in their ionic residual flux removal and the blends approaching 2% methanol are too close to the undesirable flash point region. The blend judged to be most preferred is 1% methanol, 3% sec-butanol and 3% 2-methyl-3-butyn-2-ol.

These compositions, as do all methylchloroform compositions which may be employed in contact with metals, especially aluminum, must be stabilized. Any of a number of compounds are useful as stabilizers, including diethylene ether (1,4-dioxane), dioxolanes, nitroalkanes, 1,2-butylene oxide and the like. These are well known to the art-skilled and have substantially no adverse effect on the flux removal properties. Since the known stabilized methylchloroform compositions do not completely remove the ionic flux components, it is necessary to add other solvents to them to provide for more complete removal of these ionics. The present invention provides such compositions which are shown in Table II and described in the above Summary of the Invention.

With respect to solvency for the rosin flux components, when methanol is low the other alcohol component or mixture needs to be higher in order to effect the removal of ionics. When methanol approaches 2%, the other component can be minimal. Two percent or more of methanol gives a product which has a flash point and thus is outside the scope of the invention.

TABLE II

| Example No. | MeOH (%) | SBA (%) | MBY (%) | FP | Specific Resistance (× $10^5$ ohm-cm) |
|---|---|---|---|---|---|
| 14 | 0.5 | 3 | — | P | 2* |
| 15 | 0.5 | 5 | — | P | 4* |
| 16 | 0.5 | — | 4 | P | 6* |
| 17 | 0.5 | 8 | — | P | 6* |
| 18 | 0.5 | 10 | — | P | 14 |
| 19 | 0.5 | — | 6 | P | 14 |
| 20 | 0.5 | — | 8 | P | 14 |
| 21 | 1.0 | 1 | — | P | 9* |
| 22 | 1.0 | 3 | — | P | 16 |
| 23 | 1.0 | 5 | — | P | 19 |
| 24 | 1.0 | 8 | — | P | 24 |
| 25 | 1.0 | — | 4 | F* | 9* |
| 26 | 1.0 | — | 6 | P | 16 |
| 27 | 1.0 | — | 8 | P | 16 |
| 28 | 1.0 | 2 | 2 | P | 13 |
| 29 | 1.0 | 2 | 3 | P | 16 |
| 30 | 1.0 | 3 | 2 | P | 16 |
| 31 | 1.0 | 2 | 4 | F* | 20 |
| 32 | 1.0 | 3 | 3 | P | 21 |
| 33 | 1.0 | 4 | 2 | P | 12 |
| 34 | 1.0 | 4 | 3 | P | 12 |
| 35 | 1.0 | 4 | 4 | F* | 19 |
| 36 | 2.0 | 6 | — | F* | 32 |
| 37 | 2.0 | — | 4 | F* | 15 |
| 38 | 2.0 | — | 6 | F* | 21 |

*These formulations are outside the scope of the present invention for various reasons.

Some of the blends tested above and others in which methanol and other alcohols are used were tested on a different flux (Alpha 711) which contained more ionic components than that previously tested. The results are shown in Table III.

TABLE III

| Ex. ample No. | MeOH (%) | SBA (%) | Alpha 711 Flux MBY (%) | Other # (%) | FP | Specific Resistance ($\times 10^5$ ohm-cm) |
|---|---|---|---|---|---|---|
| 39 | 1 | 3 | 3 | — | P | 10 |
| 40 | — | — | — | — | P | 2 |
| 41 | — | 3 | 3 | — | P | 5 |
| 42 | 0.5 | — | 6 | EtOH (1) | P | 14 |
| 43 | 0.5 | 6 | — | i-PrOH (2) | P | 8 |
| 44 | 1.0 | — | 3 | TAA (3) | P | 11 |
| 45 | — | — | 3 | TAA (3) | — | 3 |

#EtOH = ethanol; i-PrOH = isopropyl alcohol; TAA = t-amyl alcohol

Table III again shows the poor performance of stabilized 1,1,1-trichloroethane alone. The alcohol blends containing no methanol also show low effectiveness as compared to the methanol blends of the present invention. It is noted that since Alpha 711 flux contains 50% solids as opposed to 35% solids for 711-35 MIL it is more difficult to clean using the same set of conditions, this is reflected in the lower specific resistance values obtained.

What is claimed is:

1. A methylchloroform rosin flux removal composition having no flash point as measured by Cleveland Open Cup method consisting essentially of:

(a) a stabilized methylchloroform, (b) from about 0.5 to less than about 2 volume percent methanol, (c) from about 3 to about 10 volume percent of at least one alcohol having from 2 to 5 carbon atoms, and wherein the volume of components (b) and (c) are based on the total composition, and wherein said rosin flux is removed from a substrate by said composition to the extent that, after cleaning in said composition, said substrate upon being placed in a 75% by volume aqueous isopropyl alcohol solution for 5 minutes and subjected to ultrasonic vibration will provide a resistivity to said alcohol solution of at least $10\times10^5$ ohm-cm.

2. The composition of claim 1 wherein component (c) is 2-butanol.

3. The composition of claim 1 wherein component (c) is 2-methyl-3-butyn-2-ol.

4. The composition of claim 1 wherein component (c) is a mixture of 2-butanol and 2-methyl-3-butyn-2-ol.

5. The composition of claim 4 wherein the volumes of said butanol and methylbutynol are equal.

6. The composition of claim 4 wherein the total volume of component (c) is from about 6 to about 10 volume percent.

7. The composition of claim 1 wherein component (c) is a mixture of ethanol and 2-methyl-3-butyn-2-ol.

8. The composition of claim 1 wherein component (c) is a mixture of 2-butanol and isopropanol.

9. The composition of claim 1 wherein component (c) is a mixture of 2-methyl-3-butyn-2-ol and t-amyl alcohol.

10. The composition of claim 4 wherein component (b) is from about 0.5 to about 1 volume percent.

11. The component of claim 6 wherein the volume of component (b) is from about 0.5 to about 1.0.

* * * * *